US005086941A

United States Patent [19]

English et al.

[11] Patent Number: 5,086,941

[45] Date of Patent: Feb. 11, 1992

[54] DISPENSER CLOSURE ASSEMBLY

[75] Inventors: Brent W. English, Eau Claire; Robert W. Manthey; Kevin Gottwalt, both of Menomonie, all of Wis.

[73] Assignee: Board of Regents of the University of Wisconsin System on Behalf of University of Wisconsin - Stout, Menomonie, Wis.

[21] Appl. No.: 470,346

[22] Filed: Jan. 25, 1990

[51] Int. Cl.[5] ..... B65D 51/18

[52] U.S. Cl. ..... 220/254; 220/346; 222/153; 222/561

[58] Field of Search ..... 220/254, 345, 346; 222/153, 485, 559, 561

[56] References Cited

U.S. PATENT DOCUMENTS

| | | | |
|---|---|---|---|
| 752,586 | 2/1904 | Pitts . | |
| 949,974 | 2/1910 | Cibulka . | |
| 1,077,459 | 11/1913 | Driscoll . | |
| 1,153,379 | 9/1915 | Frankenberg . | |
| 1,217,045 | 2/1917 | Miller . | |
| 1,658,348 | 2/1928 | Michael . | |
| 2,071,960 | 2/1937 | Wilson . | |
| 2,083,565 | 6/1937 | Hothersall . | |
| 2,178,620 | 11/1939 | White . | |
| 2,183,585 | 12/1939 | Peters . | |
| 2,199,787 | 5/1940 | Dillard . | |
| 2,241,435 | 5/1941 | White . | |
| 2,480,733 | 8/1949 | Hermani . | |
| 2,898,015 | 8/1959 | Borah . | |
| 3,332,586 | 7/1967 | Amburgey | 220/245 X |
| 3,355,069 | 11/1967 | Miles . | |
| 3,363,798 | 1/1968 | Garangiotis . | |
| 4,057,167 | 11/1977 | Lee | 220/90.4 |
| 4,127,212 | 11/1978 | Waterbury | 220/254 |
| 4,170,724 | 10/1979 | Waterbury | 220/346 |
| 4,223,814 | 9/1980 | Sneider | 222/565 |
| 4,257,537 | 3/1981 | Uhlig | 222/153 |
| 4,262,802 | 4/1981 | Laauwe | 206/540 |
| 4,475,654 | 10/1984 | Fruchter | 220/345 X |
| 4,541,541 | 9/1985 | Hickman et al. | 220/253 |
| 4,570,817 | 2/1986 | Hambleton et al. | 220/345 |
| 4,607,768 | 8/1986 | Taber et al. | 222/556 |
| 4,723,693 | 2/1988 | DeCoster | 222/483 |

*Primary Examiner*—Stephen Marcus
*Assistant Examiner*—Nova Stucker
*Attorney, Agent, or Firm*—Cushman, Darby & Cushman

[57] ABSTRACT

This invention is an end closure assembly for a container. The end closure assembly comprises an end wall member for closing the end of the container and at least one flow-through aperture in the end wall member. A closure device operating with the end wall member has a first and second portion. The first portion is slidably operable to cover and uncover the flow-through aperture. The second portion is pivotally operable to lock the closure device in a fixed position.

20 Claims, 3 Drawing Sheets

Fig. 1.
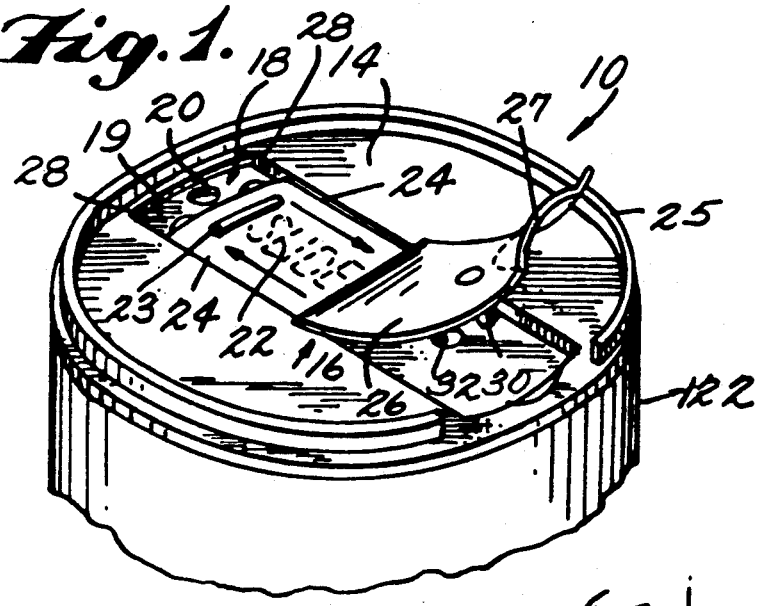
Fig. 2.
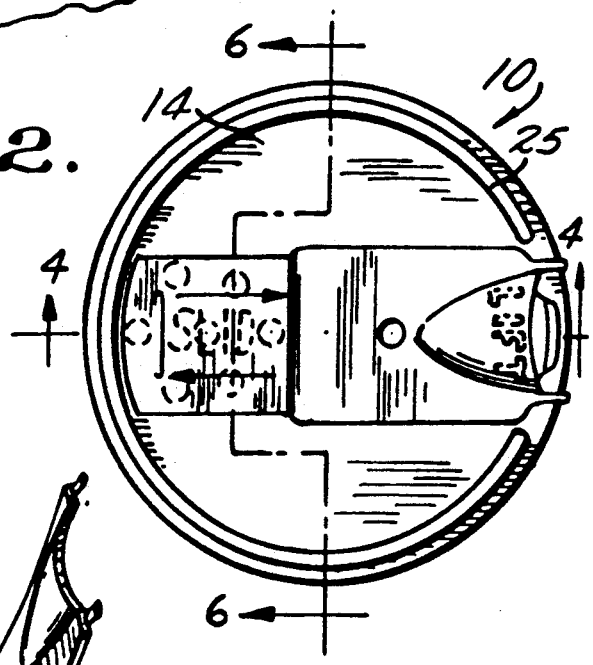
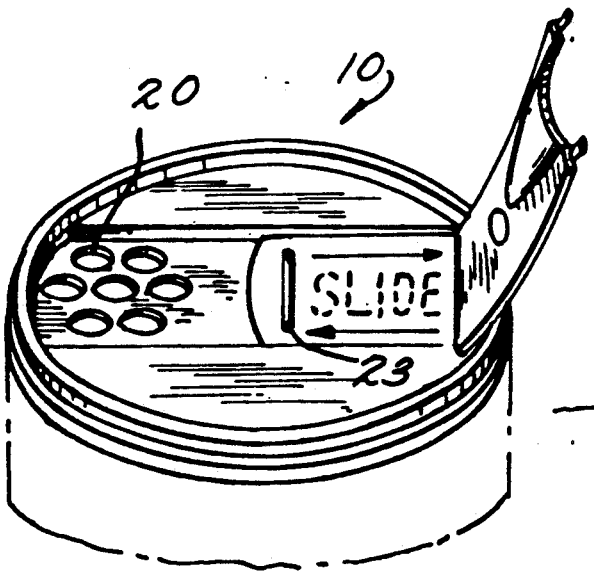
Fig. 3.

Fig. 4.
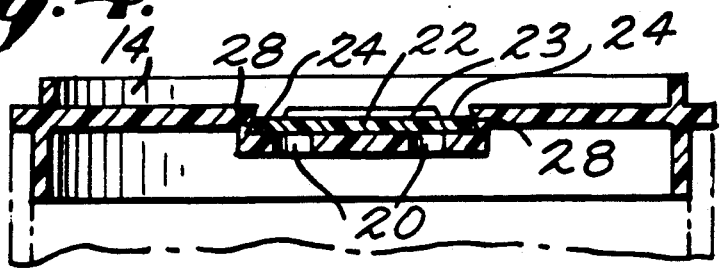
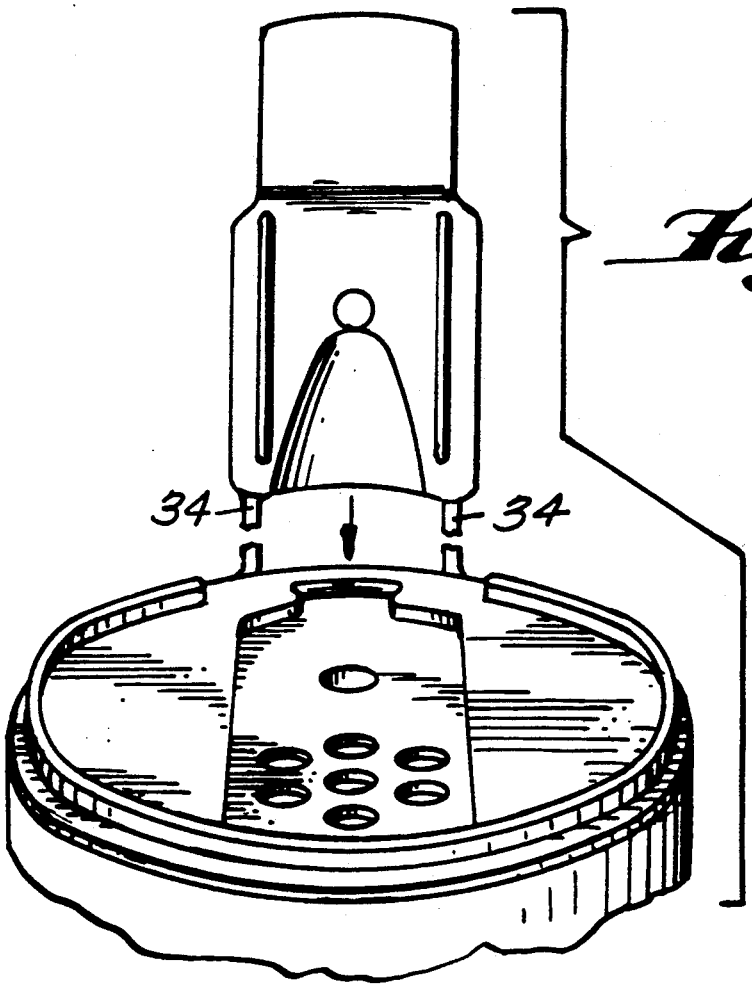
Fig. 6.
Fig. 5.
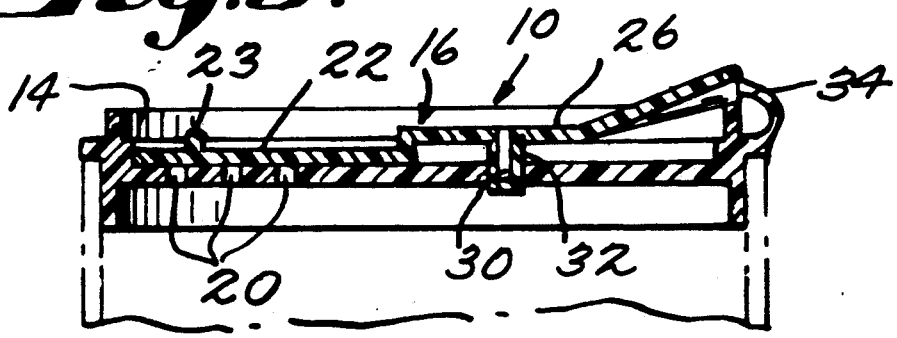

DISPENSER CLOSURE ASSEMBLY

FIELD OF THE INVENTION

This invention relates to a novel end closure assembly for dispensers, cans, containers and the like and for selectively dispensing flowable materials therefrom.

BACKGROUND OF THE INVENTION

End closure assemblies previously available have included either slidable or rotatable elements which provided a means to manually control the degree of obstruction of selectively accessible discharge ports to offer either bulk discharge or sprinkling discharge of the container contents. Further, end closure assemblies have been designed which include a pivotal element selectively alternating between an engaged and disengaged position to provide either complete obstruction or complete accessibility of the discharge ports.

Dispensers of the type mentioned above and those known in the prior art, however, do not provide an end closure assembly which provides both pivotable and slidable movement. Further, prior end closure assemblies have not provided against accidental opening while at the sam time allowing selective accessibility via a single easily manipulatable, easily manufactured closure element.

These deficiencies are not intended to be exhaustive but rather are among many which reduce the effectiveness of, and user satisfaction with, prior end closure assemblies. Thus, there is a need for an improved closure assembly.

SUMMARY OF THE INVENTION

In accordance with the principles of the present invention, one embodiment of the subject end closure assembly which is intended to accomplish at least some of the foregoing objects includes a cap having at least one aperture for dispensing the contents of the container. The end closure assembly further comprises a closure device connected to the cap by hinges and which cooperates with the cap to selectively and securely cover the dispensing apertures. The closure device includes a first portion which slides from a closed position covering the dispensing apertures to an open position. A second portion of the closure device is connected to the first portion and may be pivoted away from the cap to permit tactile sliding manipulation of the first portion.

The cap is molded to include a pathway for receiving the closure device. The closure device has flanges which cooperate with undercut portions of the pathway to ensure secure locking of the closure device. To manipulate the closure device, the second portion of the closure device is pivoted away from the pathway and tactilely manipulated to slide the first portion rearwardly to uncover the dispensing apertures of the cap. The end closure assembly is easily and inexpensively manufactured as it is molded in one piece. Further, once the closure device is installed in the pathway, the hinges must be severed to open the container, thereby providing evidence of any tampering.

With the foregoing in mind, other objects, features and advantages of the present invention will become more apparent upon consideration of the following description and the appended claims with reference to the accompanying drawings, all of which form part of this specification, wherein like reference numerals designate corresponding parts and various figures.

BRIEF DESCRIPTION OF THE DRAWINGS

FIG. 1 is a perspective view of an end closure assembly installed on a container and in a partially open position;

FIG. 2 is a top view of the end closure assembly of FIG. 1 in a completely closed position;

FIG. 3 is a perspective view of the end closure assembly of FIG. 1 in a completely open position;

FIG. 4 is a cross-sectional view taken along section line 4—4 in FIG. 2;

FIG. 5 is a detailed cross-sectional view of the end closure assembly depicting the interaction between the pathway, the undercut portions, and the closure device, as taken along section line 5—5 in FIG. 2;

FIG. 6 is an exploded perspective view of an end closure assembly;

DETAILED DESCRIPTION

Figure 7:
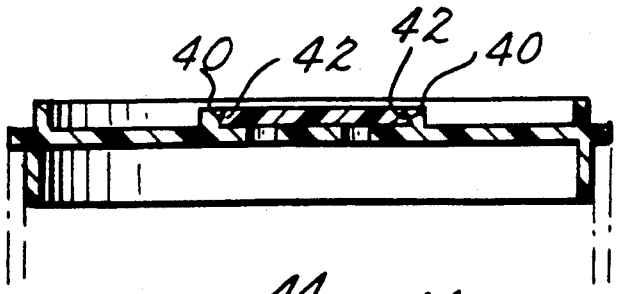
FIG. 7 is a cross sectional view of an alternative embodiment of an end closure assembly having a pathway protruding from the cap and undercut portions undercut away from each other.

FIG. 1 shows an end closure assembly 10, according to the present invention, in a partially open position. The end closure assembly 10 is attached to a container 12 and includes a cap 14 and a closure device generally indicated at 16. Cap 14 includes a molded, recessed pathway 18 having a planar bottom surface 19 in which at least one and preferably a plurality of flow-through apertures 20 is formed.

Closure device 16 comprises a first portion 22 having a grasping ridge 23 and two side-ways extending flanges 24 and a second portion 26 hingably attached to the first portion 22. In this embodiment, flanges 24 are flat, squared sides of the first portion 22. Pathway 1 includes undercut portions 28 extending along each side, best seen in FIG. 4, which slidably receive flanges 24 thereby also retaining the first portion 22 within pathway 18 but permitting relative sliding movement of portion 22 therein. The second portion 26 has a raised grasping member 27. A ridge 25, which generally runs the circumference of the cap 14, is cut away in the vicinity of the raised grasping member 27 to facilitate access to the grasping member 27. Thus, the grasping member 27 can be manipulated by one finger to lift the second portion 26. Severed hinges 34 are also seen, as will be more fully described later.

In FIG. 2, the end closure assembly 10 is shown in a fully closed position with hinges 34 intact.

In FIG. 3, the end closure assembly 10 is shown in a fully open position with the apertures 20 fully uncovered by the first portion 22. The second portion 26 is raised away from the cap 14 and hinges 34 are severed.

In FIG. 4, it can be seen how the flanges 24 slidably connect with the undercut portions 28. It can also be seen how the first portion 22 covers the flow-through apertures 20.

The end closure assembly 10 allows selective coverage of the container 12 and regulation of the outflow of the contents of the container through the flow-through apertures 20 by sliding the first portion 22 of the closure means 16 along the pathway 18. The undercut portions 28 of the pathway 18 fit tightly around the flanges 24, frictionally holding the first position 22 stationary in relationship to the flow-through apertures 20 until being moved by someone. Thus, the first portion 22 is operable to fully close (cover), partially close (cover), or completely open (uncover) the flow-through apertures 20 and will maintain the selected position.

The end closure assembly 10 contains a self-locking fastening device. As seen in FIG. 1, this comprises a downwardly extending locking protrusion 30 on the closure device 16 which releasably secures the second portion 26 of the closure device 16 into the cap 14 by fitting tightly into an aperture 32 molded into surface 19. The aperture 32 is directly under the locking protrusion 30 in the pathway 18 when the end closure assembly 10 is in a fully closed position. In an alternative embodiment, the locking protrusion and the locking aperture are switched so that the locking protrusion is on the cap and the locking aperture is in the closure device.

Turning now to FIG. 5, the closure 16 is closed, portion 22 covers apertures 20, and locking protrusion 30 has been forced into aperture 32 to lock the end closure assembly 10 in its fully closed position. FIG. 5 shows the end closure assembly 10 in its originally formed, unopened position. This provides a tamper-proof aspect for the closure to show when tampering has occurred by providing hinges 34 which initially secure the second portion 26 of the closure device 16 to the cap 14. The first portion 22 is itself secured to the second portion and is held in place by the undercut portions 28. To be able to lift second portion 26 so that first portion 22 can be slidably operated to uncover flow-through apertures 20, hinges 34 must be severed to unlock the closure. This can be done by cutting the hinges 34. The severed hinges 34 can be seen in FIGS. 1 and 3.

In one embodiment, the end closure assembly 10 is molded from a thermoplastic material. The end closure assembly 10 is inexpensive to manufacture because it can be molded in one piece, with the closure device 16 connected to the cap during the molding process by the hinges 34. The closure device 16 is subsequently inserted into the pathway 18 by folding the closure device over the cap and snapping the flanges 24 under the undercut portions 28. This can be done by machine so that the hinges do not break during the insertion process. Alternatively, this can be done by hand without breaking the hinges.

Figure 8:
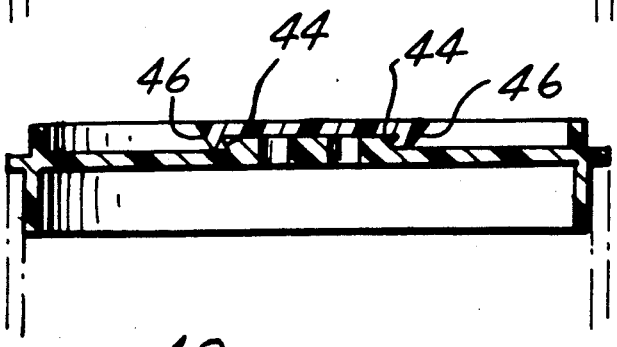
FIG. 8 is a cross sectional view of an alternative embodiment of an end closure assembly having a pathway protruding from the cap and undercut portions undercut toward each other.
Figure 9:
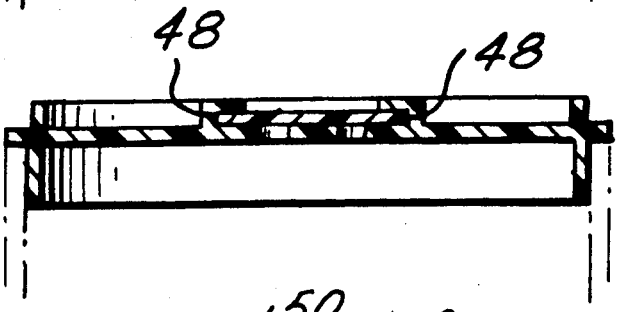
FIG. 9 is a cross sectional view of an alternative embodiment of an end closure assembly having a pathway protruding from the cap and undercut portions undercut away from each other.
Figure 10:
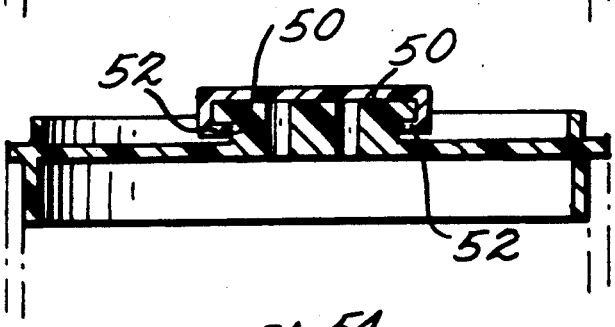
FIG. 10 is a cross sectional view of an alternative embodiment of an end closure assembly having a pathway protruding from the cap and undercut portions undercut toward each other.

FIGS. 7–12 show a variety of alternative embodiments in the end closure slide construction. Each is a cross section 4—4 as seen in FIG. 2. In FIGS. 7 and 9, cross sectional views of end closure assemblies having pathways protruding from the caps are shown. In both FIGS., undercut portions 40 and 48 of the pathways are undercut away from each other. In an alternative embodiment of the closure device, flanges 42 in FIG. 7 are beveled. In FIGS. 8 and 10, cross sectional views of end closure assemblies having pathways protruding from the caps are shown. Here the pathways are male pathways as opposed to female pathways as seen in FIGS. 7 and 9. Undercut portions 44 and 50 are undercut toward each other. In alternative embodiments of the closure device, flanges 46 and 52 are angled toward each other.

Figure 11:
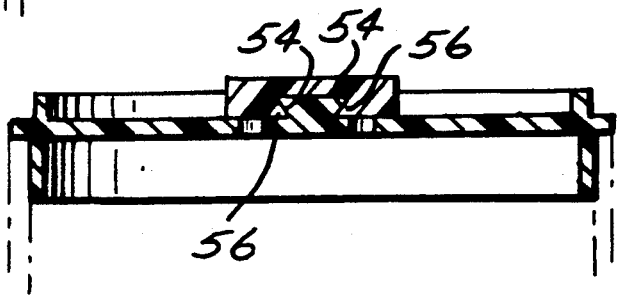
FIG. 11 is a cross sectional view of an alternative embodiment of an end closure assembly having a pathway protruding from the cap and interspersed between the flow-through apertures.
Figure 12:
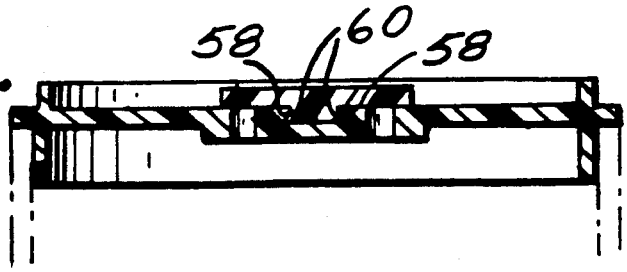
FIG. 12 is a cross sectional view of an alternative embodiment of an end closure assembly having a pathway recessed into the cap and interspersed between the flow-through apertures.

In FIG. 11, a cross sectional view of an end closure assembly having a pathway protruding from a cap is shown. Undercut portions 54 are undercut toward each other. Flanges 56 are angled toward each other. The pathway is interspersed between the flow-through apertures. FIG. 12 shows a mirror image end closure assembly of the closure assembly seen in FIG. 11. Undercut portions 58 are undercut away from each other. Flanges 60 are beveled and the pathway is interspersed between the flow-through apertures.

While the invention has been described in accordance with what is presently conceived to be the most practical and preferred embodiment, it is to be understood that the invention is not to be limited to the disclosed embodiment but on the contrary, is intended to cover various modifications and equivalent arrangements included within the spirit and the scope of the appended claims, which scope is to be accorded the broadest interpretation of such claims so as to encompass all such equivalent structures.

What is claimed is:

1. An end closure assembly for a container comprising:

an end wall member secured within and closing one end of a container, said end wall having at least one flow-through aperture for allowing dispensing of the container contents, said end wall having means defining elongated pathway means extending across the end wall, and a closure member having first and second portions hingably connected together in an end-to-end relationship, the first portion slidably operable to cover and uncover the flow-through aperture, the second portion pivotally operable to lock the closure means in a fixed position; and hinge means integral with the end wall member and the closure member which prohibits movement of the closure member with respect to the end wall member while the hinge means is intact.

2. An end closure assembly as in claim 1 wherein the pathway means operably receives the closure member and has longitudinal sides along which undercut portions are located.

3. An end closure assembly as in claim 2 wherein the pathway means is recessed into the end wall member.

4. An end closure assembly as in claim 2 wherein the pathway means protrudes from the cap end wall member.

5. An end closure assembly as in claim 3 wherein the undercut portions are undercut toward each other.

6. An end closure assembly as in claim 3 wherein the undercut portions are undercut away from each other.

7. An end closure assembly in claim 4 wherein the undercut portions are undercut toward each other.

8. An end closure assembly as in claim 4 wherein the undercut portions are undercut away from each other.

9. An end closure assembly as defined in claim 2 wherein the first portion comprises: flanges to operably cooperate with the undercut portions of the pathway means to facilitate sliding of the first portion from a closed position to an open position and reverse.

10. An end closure assembly as in claim 9 wherein the flanges are flat, squared sides of the first portion.

11. An end closure assembly as in claim 9 wherein the flanges are angled toward each other.

12. An end closure assembly as in claim 9 wherein the flanges are beveled.

13. An end closure assembly as in claim 1 wherein the second portion is pivotally connected to the first sliding portion and is operable to pivot away from a first posture in communication with the end wall member and substantially parallel to the first portion, to a second posture free from the end wall member and angled with respect to the first portion.

14. An end closure assembly as in claim 13 wherein the second portion has a grasping member for pivoting the second portion from the first posture to the second posture.

15. An end closure assembly as in claim 1 wherein the hinge means includes a first end and a second end, the hinge means being joined at the first end to the second portion and at the second end to the end wall member.

16. An end closure assembly as defined in claim 1 wherein the closure member further comprises: locking means operable to releasably secure the closure member to the end wall member in a manner such that the closure member and the end wall member fit together in a self-locking fashion to prevent movement of the closure member with respect to the end wall member.

17. An end closure assembly as in claim 16 wherein the locking means locks the closure member in a closed position.

18. An end closure assembly as in claim 16 wherein the locking means comprises a locking protrusion which releasably secures the closure member to the end wall member by inserting the locking protrusion in a locking aperture.

19. An end closure assembly as in claim 18 wherein the locking protrusion is on the closure member and the locking aperture is in the end wall member.

20. An end closure assembly as in claim 18 wherein the locking protrusion is on the end wall member and the locking aperture is in the closure member.

* * * * *